US012173601B1

(12) United States Patent
Jones et al.

(10) Patent No.: US 12,173,601 B1
(45) Date of Patent: Dec. 24, 2024

(54) NOISE CHARACTERIZATION IN FORMATION TESTING

(71) Applicant: Halliburton Energy Services, Inc., Houston, TX (US)

(72) Inventors: Christopher Michael Jones, Houston, TX (US); Mehdi Ali Pour Kallehbasti, Houston, TX (US); Ruchir Shirish Patwa, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 18/240,188

(22) Filed: Aug. 30, 2023

(51) Int. Cl.
*E21B 47/107* (2012.01)
*E21B 49/00* (2006.01)

(52) U.S. Cl.
CPC ..... *E21B 47/107* (2020.05); *E21B 49/008* (2013.01)

(58) Field of Classification Search
CPC ..... E21B 47/107; E21B 49/008
See application file for complete search history.

(56) References Cited

U.S. PATENT DOCUMENTS

| | | | |
|---|---|---|---|
| 4,893,505 | A | 1/1990 | Marsden et al. |
| 7,328,610 | B2 | 2/2008 | Manin et al. |
| 7,680,600 | B2 | 3/2010 | Carnegie et al. |
| 10,480,316 | B2 * | 11/2019 | Dumont ..... E21B 49/088 |
| 10,775,359 | B2 | 9/2020 | Jones et al. |
| 11,021,951 | B2 | 6/2021 | Olapade et al. |
| 11,371,345 | B2 | 6/2022 | Olapade et al. |
| 11,506,051 | B2 | 11/2022 | Olapade et al. |
| 11,619,130 | B1 | 4/2023 | Jones et al. |
| 11,630,233 | B2 | 4/2023 | Olapade et al. |
| 11,719,096 | B2 | 8/2023 | Olapade et al. |
| 2005/0098312 | A1 | 5/2005 | Follini et al. |
| 2011/0114310 | A1 | 5/2011 | Ross et al. |
| 2014/0121976 | A1 | 5/2014 | Kischkat |
| 2020/0284140 | A1 | 9/2020 | Jones et al. |
| 2020/0378250 | A1 | 12/2020 | Olapade et al. |
| 2020/0400017 | A1 | 12/2020 | Olapade et al. |
| 2020/0400858 | A1 | 12/2020 | Olapade et al. |
| 2021/0095526 | A1 | 4/2021 | Chanpura et al. |
| 2021/0231001 | A1 | 7/2021 | Halliburton |
| 2021/0239000 | A1 | 8/2021 | Olapade et al. |
| 2022/0275724 | A1 | 9/2022 | Olapade et al. |
| 2023/0106930 | A1 | 4/2023 | Olapade et al. |
| 2023/0221459 | A1 | 7/2023 | Olapade et al. |

OTHER PUBLICATIONS

International Search Report and Written Opinion for International Patent Application No. PCT/US2023/032426 dated May 21, 2024. PDF file. 9 pages.

* cited by examiner

*Primary Examiner* — D. Andrews
(74) *Attorney, Agent, or Firm* — Benjamin Ford; C. Tumey Law Group PLLC

(57) ABSTRACT

Herein are described methods and systems for characterizing noise and noise level during downhole pressure testing and/or sampling operations. Methods and systems may identify and quantify the noise level of a formation pressure testing and/or sampling operations by measuring pressures with the probe pressure sensor and the tool pressure sensor with and without extension of the dual probe and closing the bubble point valve that connects the probe fluid passageway to the tool fluid passageway.

18 Claims, 7 Drawing Sheets

NOISE CHARACTERIZATION IN FORMATION TESTING

BACKGROUND

Wells may be drilled at various depths to access and produce oil, gas, minerals, and other naturally occurring deposits from subterranean geological formations. The drilling of a well is typically accomplished with a drill bit that is rotated within the well to advance the well by removing topsoil, sand, clay, limestone, calcites, dolomites, or other materials. During or after drilling operations, sampling operations may be performed to collect a representative sample of formation or reservoir fluids (e.g., hydrocarbons) to further evaluate drilling operations and production potential, or to detect the presence of certain gases or other materials in the formation that may affect well performance. Pressure testing operations may be utilized by a fluid sampling tool to evaluate a formation and determine what, if any, additional operations may be performed.

During pressure testing operations, measurements taken may include noise. Noise in pressure measurements is inevitable as pumps may be running during pressure testing operations. A lot of effort is spent to denoise the pressure. However, they are strictly mathematical equations and do not quantify the noise's nature and source. The ability to measure noise and identify the source of noise may allow for reliable measurements to be taken.

BRIEF DESCRIPTION OF THE DRAWINGS

These drawings illustrate certain aspects of some examples of the present disclosure and should not be used to limit or define the disclosure.

DETAILED DESCRIPTION

The present disclosure relates to methods and systems for characterizing noise and noise level during a downhole pressure testing operation. Specifically, methods and systems may identify and quantify the noise level of a formation pressure testing and sampling operations by measuring pressures with the probe pressure sensor and the tool pressure sensor with and without extension of the dual probe and closing the bubble point valve that connects the probe fluid passageway to the tool fluid passageway. First, a first set of pressure measurements is acquired from the probe pressure sensor with at least one probe in retracted position without contacting the formation. This pressure measurement can be performed while drilling the formation or before or after formation testing. Then, the bubble point valve is closed to isolate the tool fluid passageway from the probe fluid passageway, and pressure measurements are made with the tool pressure sensor. The pressure sensors above the closed bubble point valve will be affected by the mud pump rate, mud cake, formation permeability, and overall tool vibration. The pressure sensor below the closed bubble point valve will be affected by the overall tool vibration only. Since the measurements are affected by two sources of noise, the pressure distribution shows different standard deviation and statistical parameters in general. However, when the bubble point valve is open, standard deviation of the stabilized pressure is highest as it is affected by each source of noise (mud pump rate, mud cake, formation permeability, and overall tool vibration). A second set of pressure measurements is collected from the probe pressure sensor when at least one probe is in extended position and in fluid communication with the formation. Then, the bubble point valve is closed to isolate the tool fluid passageway from the probe fluid passageway, and pressure measurements are made with the tool pressure sensor. These two sets of pressure measurements allow the distinction between common system noises, operational noise, and formation related noise. Common system noise may be from any tool vibration, gauge-related noise, and/or any other tools, etc. Operational noise sources may include mud pump rate, pulser, and its relative position to gauge, depth, and bit position. Formation-related noise is due to mud thickness and mobility of the formation.

Figure 1:
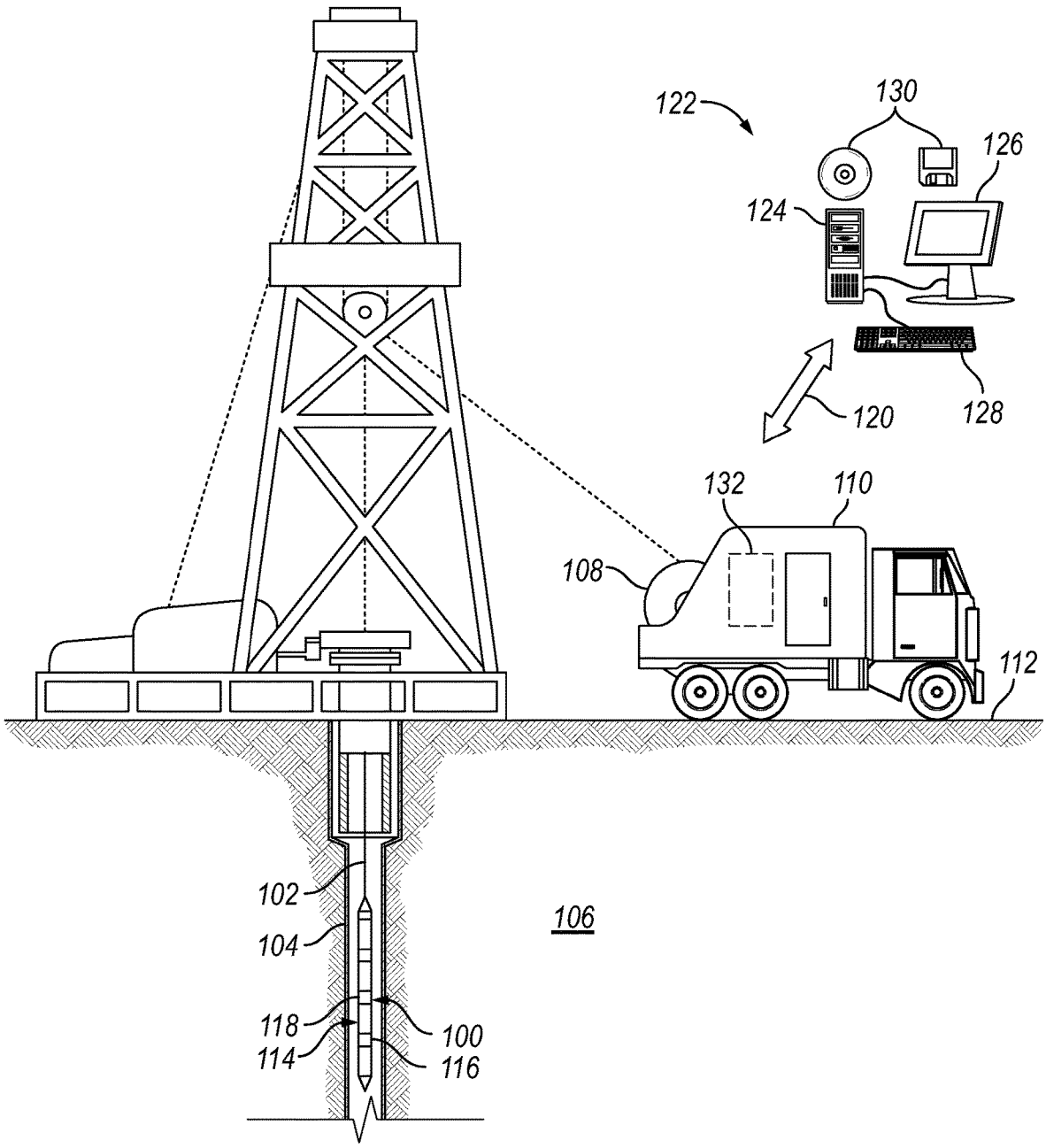
FIG. 1 illustrates a schematic view of a well in which an example embodiment of a fluid sample system is deployed.

FIG. 1 is a schematic diagram of fluid sampling and pressure testing tool 100 on a conveyance 102. As illustrated, borehole 104 may extend through subterranean formation 106. In examples, reservoir fluid may be contaminated with well fluid (e.g., drilling fluid) from borehole 104. As described herein, the fluid sample may be analyzed to determine fluid contamination and other fluid properties of the reservoir fluid. As illustrated, a borehole 104 may extend through subterranean formation 106. While the borehole 104 is shown extending generally vertically into the subterranean formation 106, the principles described herein are also applicable to boreholes that extend at an angle through the subterranean formation 106, such as horizontal and slanted boreholes. For example, although FIG. 1 shows a vertical or low inclination angle well, high inclination angle or horizontal placement of the well and equipment is also possible. It should further be noted that while FIG. 1 generally depicts a land-based operation, those skilled in the art will readily recognize that the principles described herein are equally applicable to subsea operations that employ floating or sea-based platforms and rigs, without departing from the scope of the disclosure.

As illustrated, a hoist 108 may be used to run fluid sampling and pressure testing tool 100 into borehole 104. Hoist 108 may be disposed on vehicle 110. Hoist 108 may be used, for example, to raise and lower conveyance 102 in borehole 104. While hoist 108 is shown on vehicle 110, it should be understood that conveyance 102 may alternatively be disposed from a hoist 108 that is installed at surface 112 instead of being located on vehicle 110. Fluid sampling and pressure testing tool 100 may be suspended in borehole 104 on conveyance 102. Other conveyance types may be used for conveying fluid sampling and pressure testing tool 100 into borehole 104, including coiled tubing and wired drill pipe, for example. Fluid sampling and pressure testing tool 100 may comprise a tool body 114, which may be elongated as shown on FIG. 1. Tool body 114 may be any suitable material, including without limitation titanium, stainless steel, alloys, plastic, combinations thereof, and the like. Fluid sampling and pressure testing tool 100 may further include one or more sensors 116 for measuring properties of the fluid sample, reservoir fluid, borehole 104, subterranean formation 106, or the like. In examples, fluid sampling and pressure testing tool 100 may also include a fluid analysis module 118, which may be operable to process information regarding fluid sample, as described below. The fluid sampling and pressure testing tool 100 may be used to collect fluid samples from subterranean formation 106 and may obtain and separately store different fluid samples from subterranean formation 106.

Any suitable technique may be used for transmitting signals from the fluid sampling and pressure testing tool 100 to the surface 112. As illustrated, a communication link 120 (which may be wired or wireless, for example) may be provided that may transmit data from fluid sampling and pressure testing tool 100 to an information handling system 122 at surface 112. Information handling system 122 may include a processing unit 124, a monitor 126, an input device 128 (e.g., keyboard, mouse, etc.), and/or computer media 130 (e.g., optical disks, magnetic disks) that can store code representative of the methods described herein. Information handling system 122 may act as a data acquisition system and possibly a data processing system that analyzes information from fluid sampling and pressure testing tool 100. For example, information handling system 122 may process the information from fluid sampling and pressure testing tool 100 for determination of fluid contamination. The information handling system 122 may also determine additional properties of the fluid sample (or reservoir fluid), such as component concentrations, pressure-volume-temperature properties (e.g., bubble point, phase envelop prediction, etc.) based on the fluid characterization. This processing may occur at surface 112 in real-time. Alternatively, the processing may occur downhole or at surface 112 or another location after recovery of fluid sampling and pressure testing tool 100 from borehole 104. Alternatively, the processing may be performed by an information handling system in borehole 104, such as fluid analysis module 118. The resultant fluid contamination and fluid properties may then be transmitted to surface 112, for example, in real-time. Real time may be defined within any range comprising 0.001 seconds to 0.1 seconds, 0.1 seconds to 1 second, 1 second to 1 minute, 1 minute to 1 hour, 1 hour to 4 hours, or any combination of ranges provided.

Figure 2:
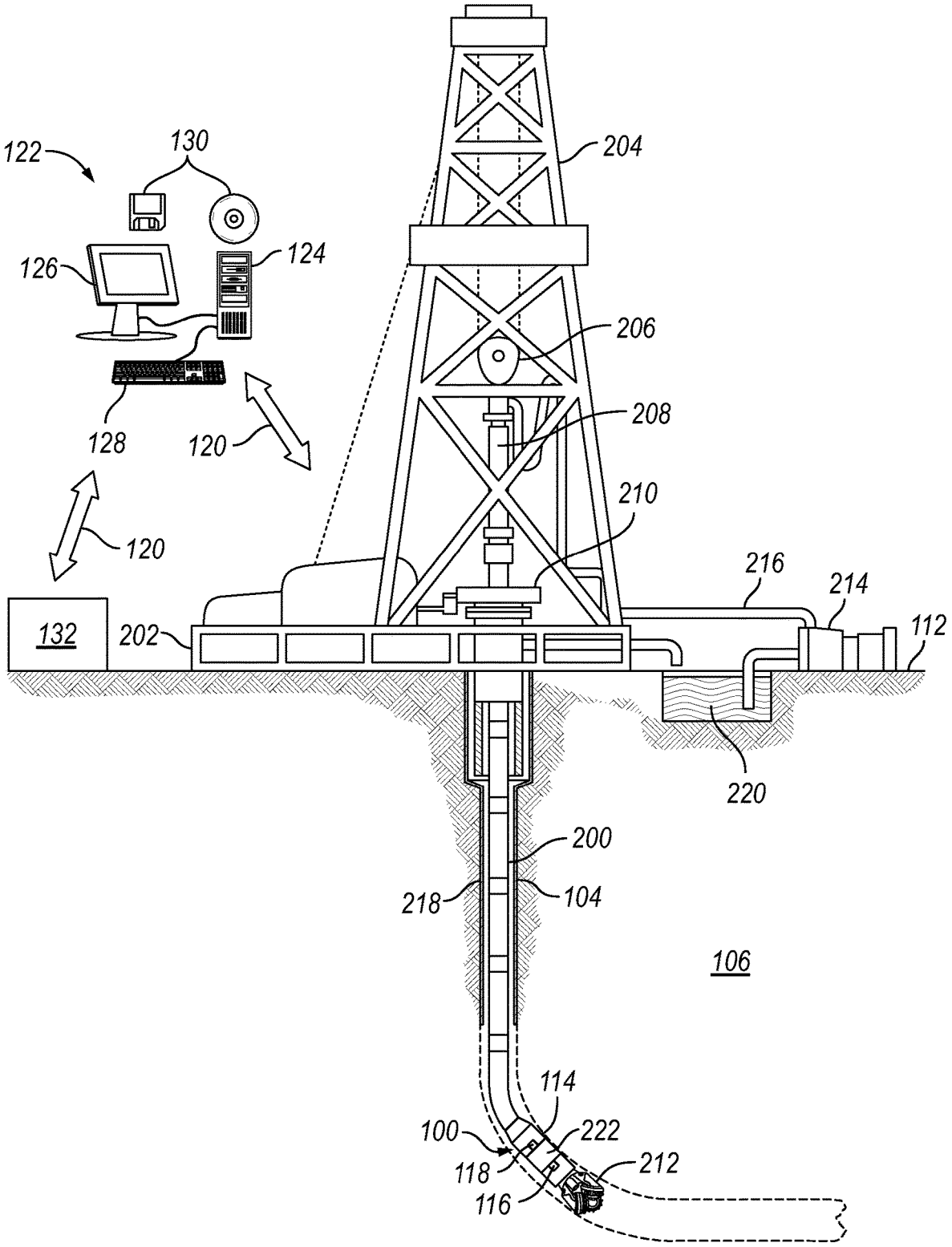
FIG. 2 illustrates a schematic view of another well in which an example embodiment of a fluid sample system is deployed.

Referring now to FIG. 2, a schematic diagram of fluid sampling and pressure testing tool 100 disposed on a drill string 200 in a drilling operation. Fluid sampling and pressure testing tool 100 may be used to obtain a fluid sample, for example, a fluid sample of a reservoir fluid from subterranean formation 106. The reservoir fluid may be contaminated with well fluid (e.g., drilling fluid) from borehole 104. As described herein, the fluid sample may be analyzed to determine fluid contamination and other fluid properties of the reservoir fluid. As illustrated, a borehole 104 may extend through subterranean formation 106. While the borehole 104 is shown extending generally vertically into the subterranean formation 106, the principles described herein are also applicable to boreholes that extend at an angle through the subterranean formation 106, such as horizontal and slanted boreholes. For example, although FIG. 2 shows a vertical or low inclination angle well, high inclination angle or horizontal placement of the well and equipment is also possible. It should further be noted that while FIG. 2 generally depicts a land-based operation, those skilled in the art will readily recognize that the principles described herein are equally applicable to subsea operations that employ floating or sea-based platforms and rigs, without departing from the scope of the disclosure.

As illustrated, drilling platform 202 may support a derrick 204 having a traveling block 206 for raising and lowering drill string 200. Drill string 200 may include, but is not limited to, drill pipe and coiled tubing, as generally known to those skilled in the art. A kelly 208 may support drill string 200 as it may be lowered through a rotary table 210. A drill bit 212 may be attached to the distal end of drill string 200 and may be driven either by a downhole motor and/or via rotation of drill string 200 from the surface 112. Without limitation, drill bit 212 may include roller cone bits, PDC bits, natural diamond bits, any hole openers, reamers, coring bits, and the like. As drill bit 212 rotates, it may create and extend borehole 104 that penetrates formation 106. A pump 214 may circulate drilling fluid through a feed pipe 216 to kelly 208, downhole through interior of drill string 200, through orifices in drill bit 212, back to surface 112 via annulus 218 surrounding drill string 200, and into a retention pit 220.

Drill bit 212 may be just one piece of a downhole assembly that may include one or more drill collars 222 and fluid sampling and pressure testing tool 100. Fluid sampling and pressure testing tool 100, which may be built into the drill collars 222 may gather measurements and fluid samples as described herein. One or more of the drill collars 222 may form a tool body 114, which may be elongated as shown on FIG. 2. Tool body 114 may be any suitable material, including without limitation titanium, stainless steel, alloys, plastic, combinations thereof, and the like. Fluid sampling and pressure testing tool 100 may be similar in configuration and operation to fluid sampling and pressure testing tool 100 shown on FIG. 1 except that FIG. 2 shows fluid sampling and pressure testing tool 100 disposed on drill string 200. Alternatively fluid sampling and pressure testing tool 100 may be lowered into the borehole after drilling operations on a wireline.

Fluid sampling and pressure testing tool 100 may further include one or more sensors 116 for measuring properties of the fluid sample reservoir fluid, borehole 104, subterranean formation 106, or the like. The one or more sensors 116 may be disposed within fluid analysis module 118. In examples, more than one fluid analysis module may be disposed on drill string 200. The properties of the fluid are measured as the fluid passes from the formation through fluid sampling and pressure testing tool 100 and into either the borehole or a sample container. As fluid is flushed in the near borehole region by the mechanical pump, the fluid that passes through fluid sampling and pressure testing tool 100 generally reduces in drilling fluid filtrate content, and generally increases in formation fluid content. The fluid sampling and pressure testing tool 100 may be used to collect a fluid sample from subterranean formation 106 when the filtrate content has been determined to be sufficiently low. Sufficiently low depends on the purpose of sampling. For some laboratory testing below 10% drilling fluid contamination is sufficiently low, and for other testing below 1% drilling fluid filtrate contamination is sufficiently low. Sufficiently low may also depend on the rate of cleanup in a cost benefit analysis since longer pump out times required to incrementally reduce the contamination levels may have prohibitively large costs. As previously described, the fluid sample may comprise a reservoir fluid, which may be contaminated with a drilling fluid or drilling fluid filtrate. Fluid sampling and pressure testing tool 100 may obtain and separately store different fluid samples from subterranean formation 106 with fluid analysis module 118. Fluid analysis module 118 may operate and function in the same manner as described above. However, storing of the fluid samples in the fluid sampling and pressure testing tool 100 may be based on the determination of the fluid contamination. For example, if the fluid contamination exceeds a tolerance, then the fluid sample may not be stored. If the fluid contamination is within a tolerance, then the fluid sample may be stored in fluid sampling and pressure testing tool 100. In examples, contamination may be defined within fluid analysis module 118.

As previously described, information from fluid sampling and pressure testing tool 100 may be transmitted to an information handling system 122, which may be located at surface 112. As illustrated, communication link 120 (which may be wired or wireless, for example) may be provided that may transmit data from fluid sampling and pressure testing tool 100 to an information handling system 111 at surface 112. Information handling system 140 may include a processing unit 124, a monitor 126, an input device 128 (e.g., keyboard, mouse, etc.), and/or computer media 130 (e.g., optical disks, magnetic disks) that may store code representative of the methods described herein. In addition to, or in place of processing at surface 112, processing may occur downhole (e.g., fluid analysis module 118). In examples, information handling system 122 may perform computations to estimate electromagnetic properties of a fluid sample.

Figure 3:
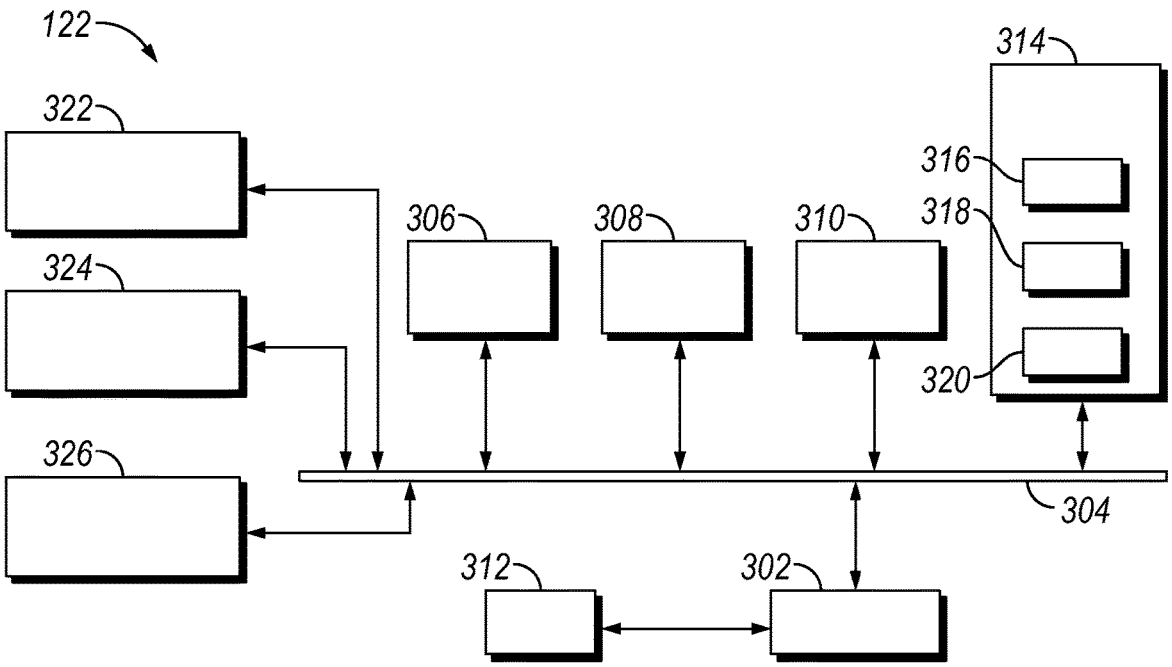
FIG. 3 illustrates a schematic view of a chipset in an information handling system.

FIG. 3 illustrates an example information handling system 122 which may be employed to perform various steps, methods, and techniques disclosed herein. As illustrated, information handling system 122 includes a processing unit (CPU or processor) 302 and a system bus 304 that couples various system components including system memory 306 such as read only memory (ROM) 308 and random-access memory (RAM) 310 to processor 302. Processors disclosed herein may all be forms of this processor 302. Information handling system 122 may include a cache 312 of high-speed memory connected directly with, in close proximity to, or integrated as part of processor 302. Information handling system 122 copies data from memory 306 and/or storage device 314 to cache 312 for quick access by processor 302. In this way, cache 312 provides a performance boost that avoids processor 302 delays while waiting for data. These and other modules may control or be configured to control processor 302 to perform various operations or actions. Other system memory 306 may be available for use as well. Memory 306 may include multiple different types of memory with different performance characteristics. It may be appreciated that the disclosure may operate on information handling system 122 with more than one processor 302 or on a group or cluster of computing devices networked together to provide greater processing capability. Processor 302 may include any general purpose processor and a hardware module or software module, such as first module 316, second module 318, and third module 320 stored in storage device 314, configured to control processor 302 as well as a special-purpose processor where software instructions are incorporated into processor 302. Processor 302 may be a self-contained computing system, containing multiple cores or processors, a bus, memory controller, cache, etc. A multi-core processor may be symmetric or asymmetric. Processor 302 may include multiple processors, such as a system having multiple, physically separate processors in different sockets, or a system having multiple processor cores on a single physical chip. Similarly, processor 302 may include multiple distributed processors located in multiple separate computing devices but working together such as via a communications network. Multiple processors or processor cores may share resources such as memory 306 or cache 312 or may operate using independent resources. Processor 302 may include one or more state machines, an application specific integrated circuit (ASIC), or a programmable gate array (PGA) including a field PGA (FPGA).

Each individual component discussed above may be coupled to system bus 304, which may connect each and every individual component to each other. System bus 304 may be any of several types of bus structures including a memory bus or memory controller, a peripheral bus, and a local bus using any of a variety of bus architectures. A basic input/output (BIOS) stored in ROM 308 or the like, may provide the basic routine that helps to transfer information between elements within information handling system 122, such as during start-up. Information handling system 122 further includes storage devices 314 or computer-readable storage media such as a hard disk drive, a magnetic disk drive, an optical disk drive, tape drive, solid-state drive, RAM drive, removable storage devices, a redundant array of inexpensive disks (RAID), hybrid storage device, or the like. Storage device 314 may include software modules 316, 318, and 320 for controlling processor 302. Information handling system 122 may include other hardware or software modules. Storage device 314 is connected to the system bus 304 by a drive interface. The drives and the associated computer-readable storage devices provide nonvolatile storage of computer-readable instructions, data structures, program modules and other data for information handling system 122. In one aspect, a hardware module that performs a particular function includes the software component stored in a tangible computer-readable storage device in connection with the necessary hardware components, such as processor 302, system bus 304, and so forth, to carry out a particular function. In another aspect, the system may use a processor and computer-readable storage device to store instructions which, when executed by the processor, cause the processor to perform operations, a method or other specific actions. The basic components and appropriate variations may be modified depending on the type of device, such as whether information handling system 122 is a small, handheld computing device, a desktop computer, or a computer server. When processor 302 executes instructions to perform "operations", processor 302 may perform the operations directly and/or facilitate, direct, or cooperate with another device or component to perform the operations.

As illustrated, information handling system 122 employs storage device 314, which may be a hard disk or other types of computer-readable storage devices which may store data that are accessible by a computer, such as magnetic cassettes, flash memory cards, digital versatile disks (DVDs), cartridges, random access memories (RAMs) 310, read only memory (ROM) 308, a cable containing a bit stream and the like, may also be used in the exemplary operating environment. Tangible computer-readable storage media, computer-readable storage devices, or computer-readable memory devices, expressly exclude media such as transitory waves, energy, carrier signals, electromagnetic waves, and signals per se.

To enable user interaction with information handling system 122, an input device 322 represents any number of input mechanisms, such as a microphone for speech, a touch-sensitive screen for gesture or graphical input, keyboard, mouse, motion input, speech and so forth. Additionally, input device 322 may take in data from one or more sensors 136, discussed above. An output device 324 may also be one or more of a number of output mechanisms known to those of skill in the art. In some instances, multimodal systems enable a user to provide multiple types of input to communicate with information handling system 122. Communications interface 326 generally governs and manages the user input and system output. There is no restriction on operating on any particular hardware arrangement and therefore the basic hardware depicted may easily be substituted for improved hardware or firmware arrangements as they are developed.

As illustrated, each individual component described above is depicted and disclosed as individual functional blocks. The functions these blocks represent may be provided through the use of either shared or dedicated hardware, including, but not limited to, hardware capable of executing software and hardware, such as a processor 302, that is purpose-built to operate as an equivalent to software executing on a general purpose processor. For example, the functions of one or more processors presented in FIG. 3 may be provided by a single shared processor or multiple processors. (Use of the term "processor" should not be construed to refer exclusively to hardware capable of executing software.) Illustrative embodiments may include microprocessor and/or digital signal processor (DSP) hardware, read-only memory (ROM) 308 for storing software performing the operations described below, and random-access memory (RAM) 310 for storing results. Very large-scale integration (VLSI) hardware embodiments, as well as custom VLSI circuitry in combination with a general-purpose DSP circuit, may also be provided.

The logical operations of the various methods, described below, are implemented as: (1) a sequence of computer implemented steps, operations, or procedures running on a programmable circuit within a general use computer, (2) a sequence of computer implemented steps, operations, or procedures running on a specific-use programmable circuit; and/or (3) interconnected machine modules or program engines within the programmable circuits. Information handling system 122 may practice all or part of the recited methods, may be a part of the recited systems, and/or may operate according to instructions in the recited tangible computer-readable storage devices. Such logical operations may be implemented as modules configured to control processor 302 to perform particular functions according to the programming of software modules 316, 318, and 320.

In examples, one or more parts of the example information handling system 122, up to and including the entire information handling system, may be virtualized. For example, a virtual processor may be a software object that executes according to a particular instruction set, even when a physical processor of the same type as the virtual processor is unavailable. A virtualization layer or a virtual "host" may enable virtualized components of one or more different computing devices or device types by translating virtualized operations to actual operations. Ultimately however, virtualized hardware of every type is implemented or executed by some underlying physical hardware. Thus, a virtualization compute layer may operate on top of a physical compute layer. The virtualization compute layer may include one or more virtual machines, an overlay network, a hypervisor, virtual switching, and any other virtualization application.

Figure 4:
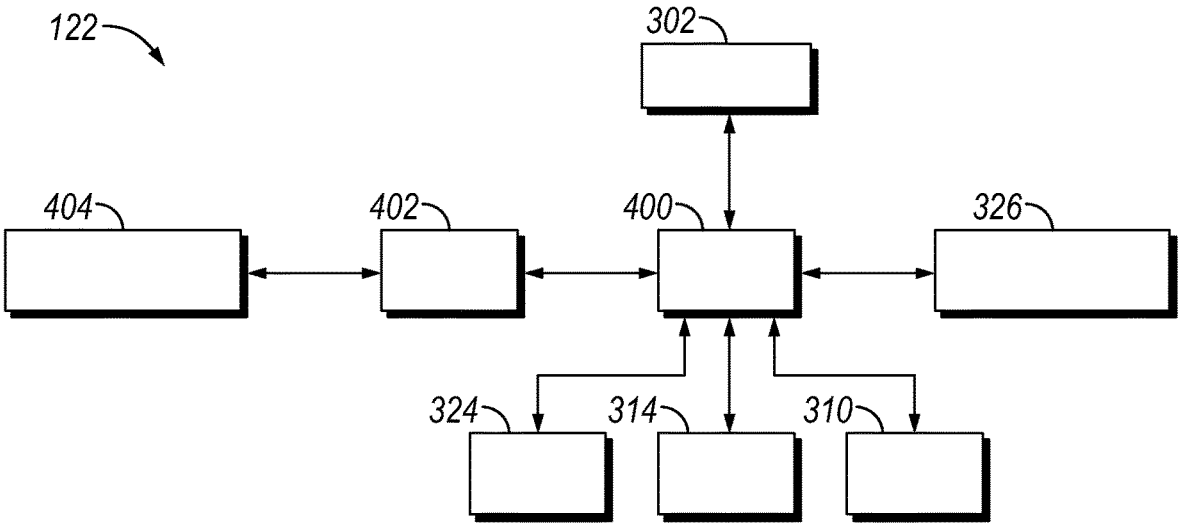
FIG. 4 illustrates the chipset in communication with other components of the information handling system.

FIG. 4 illustrates an example information handling system 122 having a chipset architecture that may be used in executing the described method and generating and displaying a graphical user interface (GUI). Information handling system 122 is an example of computer hardware, software, and firmware that may be used to implement the disclosed technology. Information handling system 122 may include a processor 302, representative of any number of physically and/or logically distinct resources capable of executing software, firmware, and hardware configured to perform identified computations. Processor 302 may communicate with a chipset 400 that may control input to and output from processor 302. In this example, chipset 400 outputs information to output device 324, such as a display, and may read and write information to storage device 314, which may include, for example, magnetic media, and solid-state media. Chipset 400 may also read data from and write data to RAM 310. A bridge 402 for interfacing with a variety of user interface components 404 may be provided for interfacing with chipset 400. Such user interface components 404 may include a keyboard, a microphone, touch detection and processing circuitry, a pointing device, such as a mouse, and so on. In general, inputs to information handling system 122 may come from any of a variety of sources, machine generated and/or human generated.

Chipset 400 may also interface with one or more communication interfaces 326 that may have different physical interfaces. Such communication interfaces may include interfaces for wired and wireless local area networks, for broadband wireless networks, as well as personal area networks. Some applications of the methods for generating, displaying, and using the GUI disclosed herein may include receiving ordered datasets over the physical interface or be generated by the machine itself by processor 302 analyzing data stored in storage device 314 or RAM 310. Further, information handling system 122 receives inputs from a user via user interface components 404 and executes appropriate functions, such as browsing functions by interpreting these inputs using processor 302.

In examples, information handling system 122 may also include tangible and/or non-transitory computer-readable storage devices for carrying or having computer-executable instructions or data structures stored thereon. Such tangible computer-readable storage devices may be any available device that may be accessed by a general purpose or special purpose computer, including the functional design of any special purpose processor as described above. By way of example, and not limitation, such tangible computer-readable devices may include RAM, ROM, EEPROM, CD-ROM or other optical disk storage, magnetic disk storage or other magnetic storage devices, or any other device which may be used to carry or store desired program code in the form of computer-executable instructions, data structures, or processor chip design. When information or instructions are provided via a network, or another communications connection (either hardwired, wireless, or combination thereof), to a computer, the computer properly views the connection as a computer-readable medium. Thus, any such connection is properly termed a computer-readable medium. Combinations of the above should also be included within the scope of the computer-readable storage devices.

Computer-executable instructions include, for example, instructions and data which cause a general-purpose computer, special purpose computer, or special purpose processing device to perform a certain function or group of functions. Computer-executable instructions also include program modules that are executed by computers in standalone or network environments. Generally, program modules include routines, programs, components, data structures, objects, and the functions inherent in the design of special-purpose processors, etc. that perform particular tasks or implement particular abstract data types. Computer-executable instructions, associated data structures, and program modules represent examples of the program code means for executing steps of the methods disclosed herein. The particular sequence of such executable instructions or associated data structures represents examples of corresponding acts for implementing the functions described in such steps.

In additional examples, methods may be practiced in network computing environments with many types of computer system configurations, including personal computers, hand-held devices, multi-processor systems, microprocessor-based or programmable consumer electronics, network PCs, minicomputers, mainframe computers, and the like. Examples may also be practiced in distributed computing environments where tasks are performed by local and remote processing devices that are linked (either by hardwired links, wireless links, or by a combination thereof) through a communications network. In a distributed computing environment, program modules may be located in both local and remote memory storage devices.

Figure 5:
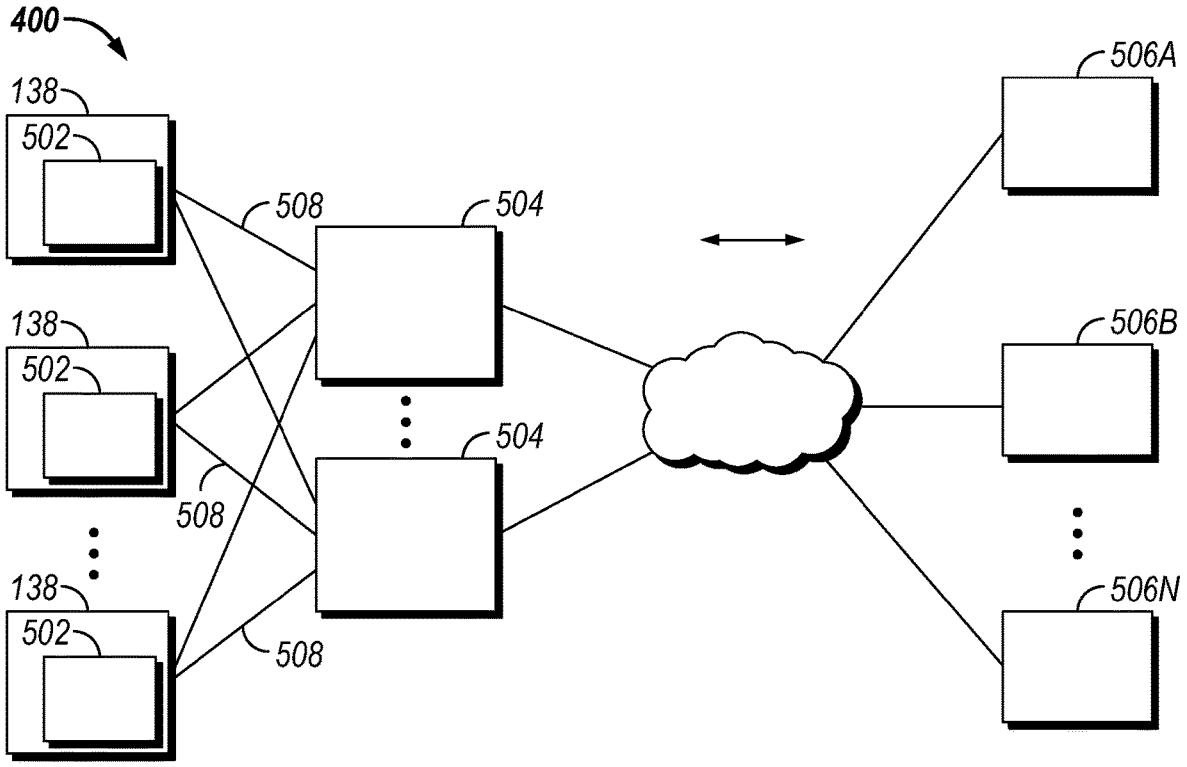
FIG. 5 illustrates an example of one arrangement of resources in a computing network.

FIG. 5 illustrates an example of one arrangement of resources in a computing network 500 that may employ the processes and techniques described herein, although many others are of course possible. As noted above, an information handling system 122, as part of their function, may utilize data, which includes files, directories, metadata (e.g., access control list (ACLS) creation/edit dates associated with the data, etc.), and other data objects. The data on the information handling system 122 is typically a primary copy (e.g., a production copy). During a copy, backup, archive or other storage operation, information handling system 122 may send a copy of some data objects (or some components thereof) to a secondary storage computing device 504 by utilizing one or more data agents 502.

A data agent 502 may be a desktop application, website application, or any software-based application that is run on information handling system 122. As illustrated, information handling system 122 may be disposed at any rig site (e.g., referring to FIG. 1) or repair and manufacturing center. Data agent 502 may communicate with a secondary storage computing device 504 using communication protocol 508 in a wired or wireless system. Communication protocol 508 may function and operate as an input to a website application. In the website application, field data related to pre- and post-operations, generated DTCs, notes, and the like may be uploaded. Additionally, information handling system 122 may utilize communication protocol 508 to access processed measurements, operations with similar DTCs, troubleshooting findings, historical run data, and/or the like. This information is accessed from secondary storage computing device 504 by data agent 502, which is loaded on information handling system 122.

Secondary storage computing device 504 may operate and function to create secondary copies of primary data objects (or some components thereof) in various cloud storage sites 506A-N. Additionally, secondary storage computing device 504 may run determinative algorithms on data uploaded from one or more information handling systems 138, discussed further below. Communications between the secondary storage computing devices 504 and cloud storage sites 506A-N may utilize REST protocols (Representational state transfer interfaces) that satisfy basic C/R/U/D semantics (Create/Read/Update/Delete semantics), or other hypertext transfer protocol ("HTTP")-based or file-transfer protocol ("FTP")-based protocols (e.g., Simple Object Access Protocol).

In conjunction with creating secondary copies in cloud storage sites 506A-N, the secondary storage computing device 504 may also perform local content indexing and/or local object-level, sub-object-level or block-level deduplication when performing storage operations involving various cloud storage sites 506A-N. Cloud storage sites 506A-N may further record and maintain DTC code logs for each downhole operation or run, map DTC codes, store repair and maintenance data, store operational data, and/or provide outputs from determinative algorithms that are fun at cloud storage sites 506A-N. In examples, computing network 500 may be communicatively coupled to fluid sampling and pressure testing tool 100.

Figure 6:
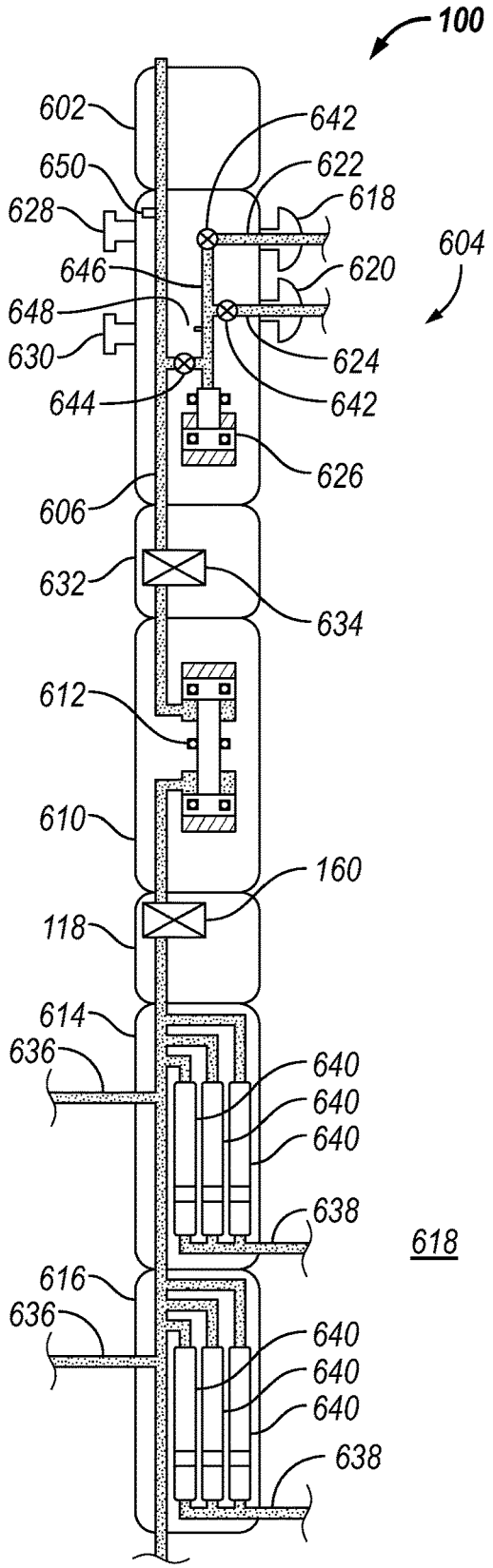
FIG. 6 illustrates a schematic view of an example embodiment of a fluid sampling tool.

FIG. 6 illustrates a schematic of fluid sampling and pressure testing tool 100. As illustrated, fluid sampling and pressure testing tool 100 may comprise probe 604. Probe 604 may extract fluid from the reservoir and deliver it to a tool fluid passageway 606 that extends from one end of fluid sampling and pressure testing tool 100 to the other. Without limitation, probe 604 includes two probes 618, 620 in this example, which may extend from fluid sampling and pressure testing tool 100 and press against the inner wall of borehole 104 (e.g., referring to FIG. 1). Probe channels 622, 624 may connect probes 618, 620 to tool fluid passageway 606. The high-volume bidirectional pump 612 may be used to pump fluids from the reservoir, through probe channels 622, 624 to tool fluid passageway 606. Alternatively, a low volume pump 626 may be used for this purpose. Two standoffs or stabilizers 628, 630 hold fluid sampling and pressure testing tool 100 in place as probes 618, 620 press against the wall of borehole 104. In examples, probes 618, 620 and stabilizers 628, 630 may be retracted when fluid sampling and pressure testing tool 100 may be in motion and probes 618, 620 and stabilizers 628, 630 may be extended to sample the reservoir fluids at any suitable location in borehole 104.

In examples, tool fluid passageway 606 may be connected to other tools disposed on drill string 200 or conveyance 102 (e.g., referring to FIGS. 1 and 2). Additionally, fluid sampling and pressure testing tool 100 may include a flow-control pump-out section 610, which may include a high-volume bidirectional pump 612 for pumping fluid through tool fluid passageway 606. In examples, fluid sampling and pressure testing tool 100 may include two multi-chamber sections 614, 616, referred to collectively as multi-chamber sections 614, 616 or individually as first multi-chamber section 614 and second multi-chamber section 616, respectively.

In examples, multi-chamber sections 614, 616 may be separated from flow-control pump-out section 610 by sensor section 632, which may house one or more sensors 634. Sensor 634 may be displaced within sensor section 632 in-line with tool fluid passageway 606 to be a "flow through" sensor. In alternate examples, sensor 634 may be connected to tool fluid passageway 606 via an offshoot of tool fluid passageway 606. Without limitation, sensor 634 may include optical sensors, acoustic sensors, electromagnetic sensors, conductivity sensors, resistivity sensors, selective electrodes, density sensors, mass sensors, thermal sensors, chromatography sensors, viscosity sensors, bubble point sensors, fluid compressibility sensors, flow rate sensors, microfluidic sensors, selective electrodes such as ion selective electrodes, and/or combinations thereof. In examples, sensor 634 may operate and/or function to measure drilling fluid filtrate.

Figure 7:
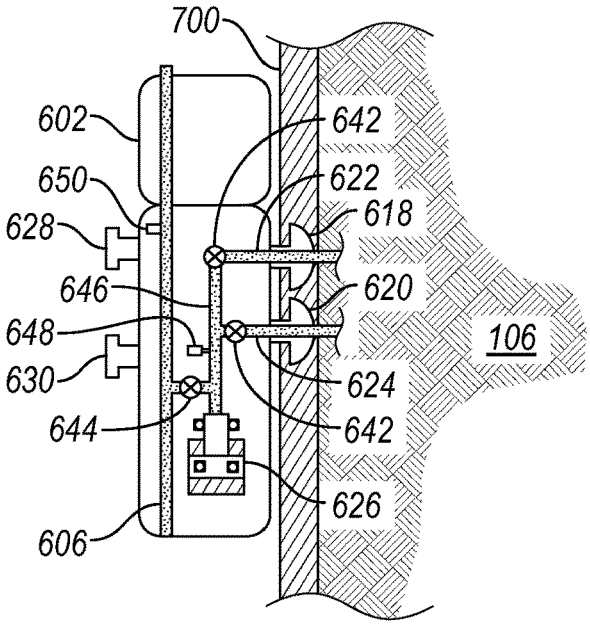
FIG. 7 is a schematic of an example embodiment of a pressure testing operation with a fluid sampling tool with a dual probe sealed to the formation.

Additionally, multi-chamber section 614, 616 may comprise access channel 636 and chamber access channel 638. Without limitation, access channel 636 and chamber access channel 638 may operate and function to either allow a solids-containing fluid (e.g., mud) disposed in borehole 104 in or provide a path for removing fluid from fluid sampling and pressure testing tool 100 into borehole 104. As illustrated, multi-chamber section 614, 616 may comprise a plurality of chambers 640. Chambers 640 may be sampling chamber that may be used to sample borehole fluids, reservoir fluids, and/or the like during measurement operations. It should be noted that fluid sampling and pressure testing tool 100 may also be used in pressure testing operations. For example, during pressure testing operations a drawdown operation may be performed. During this operation probes 618, 620 may be pressed against the inner wall of the borehole of formation 106 through mud filtercake 700, as illustrated in FIG. 7.

Figure 8:
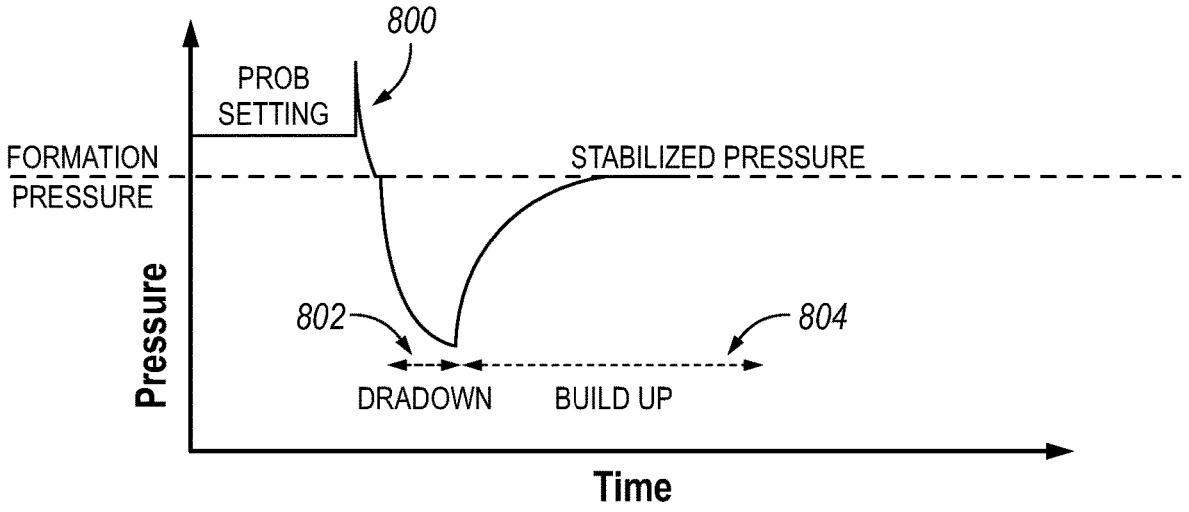
FIG. 8 is a graph of pressure fluctuation during a pressure testing operation.

Referring now to FIG. 8, pressure may increase at probes 618, 620 (referring to FIG. 7) due to formation 106 exerting pressure on probes 618, 620. As pressure rises and reaches a predetermined pressure 800, valve 642 opens so as to close bubble point valve 644, thereby isolating probe fluid passageway 646 from annulus 218. In this manner, probe fluid passageway valve 642 ensures that bubble point valve 644 closes only after probes 618, 620 has entered contact with mud filtercake 700 that is disposed against the inner wall of the borehole of formation 106. As probes 618, 620 are pressed against the inner wall of the borehole of formation 106, the pressure rises and closes the valve 642 in fluid passageway 646, thereby isolating the probe fluid passageway 646 from the annulus 218 (e.g., referring to FIG. 2). In this manner, fluid passageway 646 is now close to annulus 218 and is in fluid communication with low volume pump 626.

As low volume pump 626 is actuated, formation fluid may thus be drawn through probe channels 622, 624 and probes 618, 620. With reference to FIG. 8, the movement of low volume pump 626 lowers the pressure (i.e., drawdown 802) in probe fluid passageway 646 to a pressure below the formation pressure, such that formation fluid is drawn through probes 618, 620, probe channels 622, 624, and into fluid passageway 646. The pressure of the formation fluid may be measured in probe fluid passageway 646 while probes 618, 620 serve as a seal to prevent annular fluids from entering probe fluid passageway 646 and invalidating the formation pressure measurement.

During this interval, probe pressure sensor 648 may continuously monitor the pressure in probe fluid passageway 646 until the pressure stabilizes, or after a predetermined time interval. When the measured pressure stabilizes, or after a predetermined time interval, for example at 1800 psi, pressure is sensed by probe pressure sensor 648 to complete drawdown operations. Once complete, fluid for the pressure test in probe fluid passageway 646 may be dispelled from formation sampling and pressure testing tool 100 through the opening and/or closing of valves 642 and/or bubble point valve 644 as low volume pump 626 returns to a starting position.

With low volume pump 626 in its fully retracted position and formation fluid drawn into fluid passageway 646, the pressure will stabilize (i.e., buildup 804 in FIG. 8) and enable a first pressure sensor, probe pressure sensor 648, to sense and measure formation fluid pressure. The measured pressure is transmitted to information handling system 122 disposed on fluid sampling and pressure testing tool 100 and/or it may be transmitted to the surface via mud pulse telemetry or by any other conventional telemetry means to an information handling system 122 disposed on surface 112.

During pressure testing operations, as described above, noise is measured. Noise may originate from any number of sources. For example, noise may be categorized as common system, operational noise, or formation-related noise. Common system noise may be from any tool vibration, gauge-related noise, and/or any other tools, etc. Operational noise sources may include mud pump rate, pulser, and its relative position to gauge, depth, and bit position. Additionally, formation-related noise is due to mud thickness and mobility of the formation. Noisy pressure data can potentially cause over/underestimated pressure and uncertain pressure gradient. However, noise may be inevitable during measurement operations in which pumps may be utilized. A lot of effort is spent to denoise the pressure. However, current noise removal methods are strictly mathematical equations and do not quantify the noise's nature and source.

Referring to FIG. 7, fluid sampling and pressure testing tool 100 may create an isolated chamber through the closing of bubble point valve 644. In this test, an isolated flow line section is formed within tool fluid passageway 606 by closing bubble point valve 644. Bubble point valve 644 cuts fluid communication between tool fluid passageway 606 and probe fluid passageway 646, which leads to formation 106. This separates probe pressure sensor 648, discussed above, and tool pressure sensor 650. Tool pressure sensor 650 may be disposed on the other side of tool fluid passageway 606 from bubble point valve 644. Tool pressure sensor 650 may sense and measure fluid pressure within tool fluid passageway 606. The measured pressure from tool pressure sensor 650 is transmitted to information handling system 122 disposed on fluid sampling and pressure testing tool 100 and/or it may be transmitted to the surface via mud pulse telemetry or by any other conventional telemetry means to an information handling system 122 disposed on surface 112. Without limitation, fluid sampling and pressure testing tool 100 may also be used in pressure testing operations. Probe pressure sensor 648 and tool pressure sensor 650, each separated by bubble point valve 644, make it possible to measure pressure within tool fluid passageway 606 and probe fluid passageway 646. Utilizing probe pressure sensor 648 and tool pressure sensor 650, a combination of regular formation testing, and isolated testing may be performed. This way, common system noise, operational noise, and formation related noise may be identified.

Figure 9:
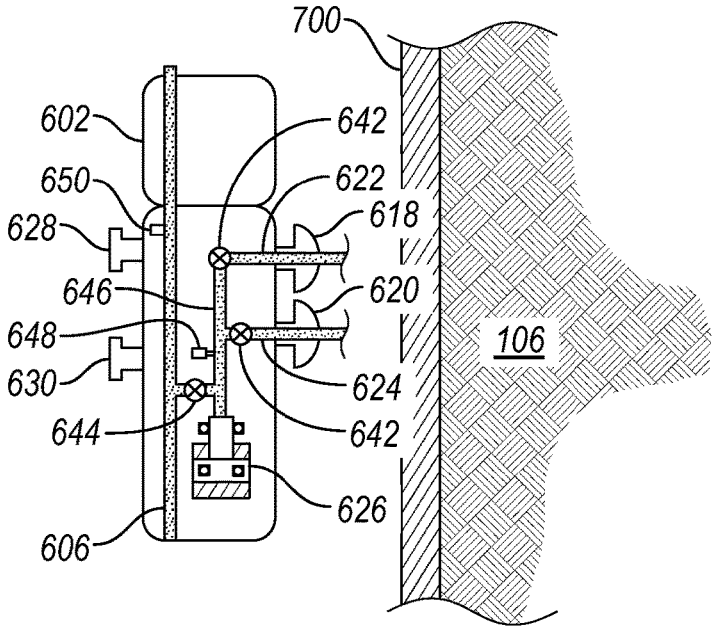
FIG. 9 is a schematic of an example embodiment of a pressure testing operation with a fluid sampling tool with extended dual probe not in contact with the formation.

Referring to FIG. 9, during pressure testing operations when probes 618, 620 are extended to the inner wall of the borehole of formation 106 but probes 618, 620 have not contacted the inner wall of the borehole of formation 106 yet, a first pressure may be taken at probe pressure sensor 648 and tool pressure sensor 650. Alternatively, the first pressure measurement may be taken at probe pressure sensor 648 while drilling without probes 618, 620 extended to the inner wall of the borehole of formation 106. During this first pressure measurement with probe pressure sensor 648, bubble point valve 644 is not closed. Measurements from probe pressure sensor 648 and tool pressure sensor 650 should be similar. If there is any difference in pressures measured by probe pressure sensor 648 and tool pressure sensor 650, it is due to the common system noise.

After measuring pressure at first pressure sensor 648, bubble point valve 644 is closed, and at least one pressure measurement is taken at tool pressure sensor 650. The difference in pressures measured by probe pressure sensor 648 and tool pressure sensor 650 is due to common system noise and operational noise.

Referring now to FIG. 7, once probes 618, 620 have contacted the inner wall of the borehole of formation 106, pressure testing operations may be performed as discussed for FIG. 8 above. After a stabilized pressure is received after buildup 804, bubble point valve 644 (turning back to FIG. 7) is closed, isolating tool pressure sensor 650 from formation 106 and/or probe pressure sensor 648. At this stage, there should not be any pump working and there should not be any operational noise. If the pressures measured by probe pressure sensor 648 and tool pressure sensor 650 are identical while bubble point valve 644 is closed, it indicates probes 618, 620 are not in fluid communication with formation 106 and pressure drop during drawdown 802 (e.g., referring to FIG. 8) of the pressure testing operation is due to flow line fluid compressibility. This should be an indication of the quality of the seal between probes 618, 620 and formation 106 and the type of fluid within tool fluid passageway 606. If the pressures measured by probe pressure sensor 648 and tool pressure sensor 650 are different, the difference is due to common system noise and formation related noise.

Therefore, pressure measurements performed before and during pressure testing operation can decouple common system noise, from operation noise, from formation related noise. Specifically, common system noise can be obtained when probes 618, 620 (extended or not) are not in contact with the inner wall of the borehole of formation 106 while drilling or before or after formation pressure testing, with bubble point valve 644 still open. In the same situation but with bubble point valve 644 closed, the combination of common system noise and operational noise is obtained from the difference between the pressure measured by probe pressure sensor 648 and the pressure measured by tool pressure sensor 650. Finally, the combination of common system noise and formation related noise is obtained from the difference between the pressure measured by probe pressure sensor 648 and the pressure measured by tool pressure sensor 650 after probes 618 620 are extended to the inner wall of the borehole of the formation and formation testing is almost finished. More specifically, after the measured formation pressure is stabilized and after closing bubble point valve 644 with no pump running.

Therefore, from these three stages of pressure measurements, the common system noise can be decoupled from the operation noise and from the formation related noise. Current technology is not able to detect noise in pressure testing. Currently, pressure testing is performed when the pumps are off. Normally. It is not safe to do the test when pumps are off due to operation problems and inability to transfer data. It also increases the run time for switching between pumps on and off. The methods and systems described above do not change run time and provide criteria to determine flow from a formation. Additionally, fidelity is improved to pressure measurements but also provides a diagnostic tool to identify the quality of the seal of the at least one probe with the formation.

Figure 10:
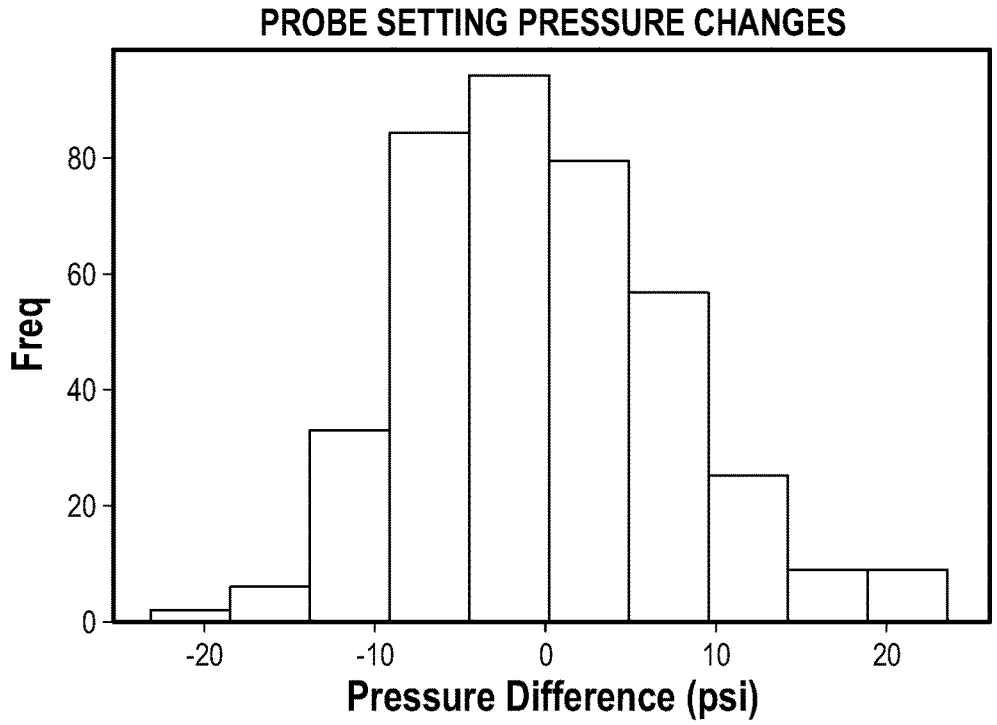
FIG. 10 is a graph of the pressure difference as a function of frequency as probe setting pressure changes when the bubble point valve is open.

FIG. 10 is a graph of the pressure difference as a function of frequency as probe setting pressure changes when bubble point valve 644 is open. Noise level as a function of the pressure difference between probe pressure sensor 648 and the pressure measured by tool pressure sensor 650 when the probe is set against the borehole with bubble point valve 644 open.

Figure 11:
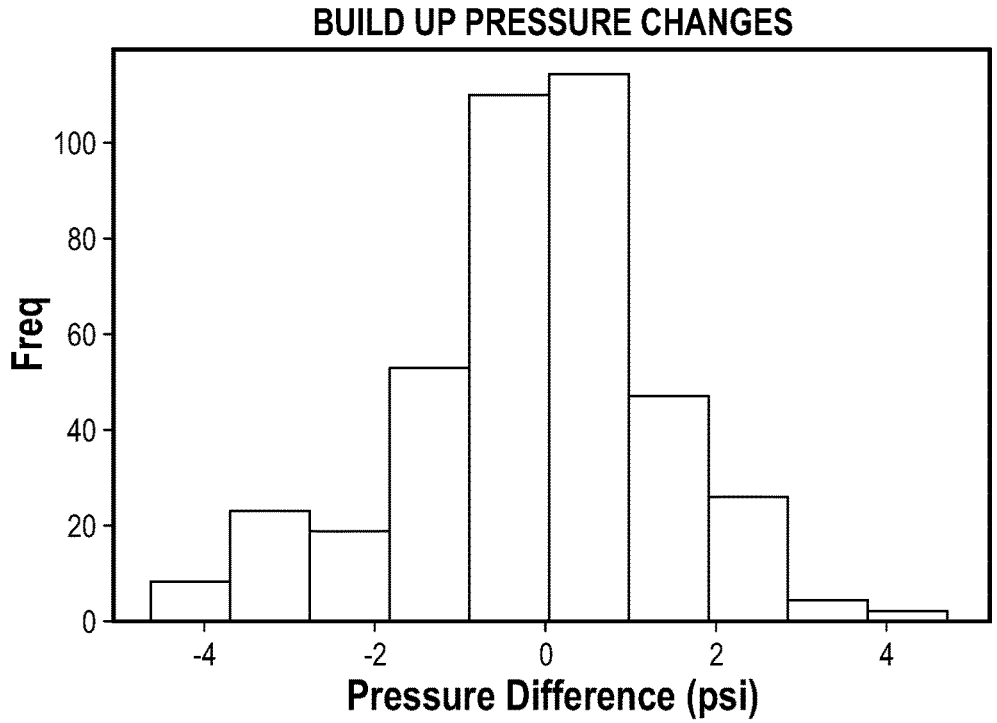
FIG. 11 is a graph of the pressure difference as a function of frequency as build up pressure changes when the bubble point valve is open.

FIG. 11 is a graph of the pressure difference as a function of frequency as build up pressure changes when bubble point valve 644 is open. Noise level as a function of the pressure difference between probe pressure sensor 648 and the pressure measured by tool pressure sensor 650 after drawdown with bubble point valve 644 open.

The larger pressure difference during probe setting versus build up pressure is due to the poor seal with the formation, higher operational noise.

Statement 1. A method comprising: disposing a formation testing and/or fluid sampling tool into a borehole, wherein the formation testing and/or fluid sampling tool comprises: one or more probes that extend into a formation; a probe fluid passageway to connect the fluid from the formation through the one or more probes; a bubble point valve that connects the probe fluid passageway to a tool fluid passageway; a probe pressure sensor disposed on the probe fluid passageway; a tool pressure sensor disposed on the formation testing and/or fluid sampling tool fluid passageway; moving the formation testing and/or fluid sampling tool to a depth within the borehole; extending the one or more probes into an inner surface of the borehole; performing a pressure testing operation; closing the bubble point valve; taking a first pressure measurement at the probe pressure sensor; and taking a second pressure measurement at the tool pressure sensor.

Statement 2. The method of Statement 1, wherein the first pressure measurement comprises noise.

Statement 3. The method of Statement 1 or Statement 2, wherein the noise comprises a common system noise, operational noise, or formation-related noise.

Statement 4. The method of any of the previous Statements, wherein the common system noise is from a tool vibration, a gauge-related noise, or another tool.

Statement 5. The method of any of the previous Statements, wherein the operational noise is from a mud pump rate, a pulser, the depth, and a bit position.

Statement 6. The method of any of the previous Statements, wherein the operational noise is from a mud thickness and mobility of the formation.

Statement 7. The method of any of the previous Statements, wherein the second pressure measurement comprises no noise.

Statement 8. The method of any of the previous Statements, further comprising comparing the first measurement to the second measurement.

Statement 9. A method of quantifying noise in downhole formation pressure testing operations comprising: disposing a formation testing tool into a borehole, wherein the formation testing tool comprises: one or more probes that extend into a formation; a probe fluid passageway to connect the fluid from the formation through the one or more probes; a bubble point valve that connects the probe fluid passageway to a tool fluid passageway; a probe pressure sensor disposed on the probe fluid passageway; a tool pressure sensor disposed on the tool fluid passageway; moving the formation testing tool to a depth within the borehole; extending the one or more probes but without contacting the inner surface of the borehole; taking a first pressure measurement at the probe pressure sensor; closing the bubble point valve; taking a second pressure measurement at the tool pressure sensor; calculating the difference between the two pressure measurements; extending the one or more probes into the inner surface of the borehole; performing a pressure testing operation; taking a first pressure measurement at the probe pressure sensor; closing the bubble point valve after pressure stabilization; taking a second pressure measurement at the tool pressure sensor; calculating the difference between the two pressure measurements; and calculating the noise in the downhole formation pressure testing operation.

Statement 10. The method of Statement 9, wherein the first pressure measurement after extending the one or more probes into the inner surface of the borehole but before closing the bubble point valve comprises noise.

Statement 11. The method of Statement 9 or Statement 10, wherein the noise comprises a common system noise and formation-related noise.

Statement 12. The method of any of Statements 9-11, wherein the common system noise is from a tool vibration, a gauge-related noise, or another tool.

Statement 13. The method of any of Statements 9-12, wherein the formation-related noise is from a mud thickness and mobility of the formation.

Statement 14. The method of any of Statements 9-13, wherein the first pressure measurement comprises noise when the one or more probes do not contact the inner surface of the borehole.

Statement 15. The method of any of Statements 9-14, wherein the noise comprises a common system noise and operational noise.

Statement 16. A method of identifying a seal between at least one probe and a downhole formation comprising: disposing a formation testing tool and/or fluid sampling tool into a borehole, wherein the formation testing tool and/or fluid sampling tool comprises: one or more probes that extend into a formation; a probe fluid passageway to connect the fluid from the formation through the one or more probes; a bubble point valve that connects the probe fluid passageway to a tool fluid passageway; a probe pressure sensor disposed on the probe fluid passageway; a tool pressure sensor disposed on the tool fluid passageway; moving the formation testing tool to a depth within the borehole; extending the one or more probes into the inner surface of the borehole; taking a first pressure measurement at the probe pressure sensor; closing the bubble point valve; taking a second pressure measurement at the tool pressure sensor; and calculating the difference between the two pressure measurements.

Statement 17. The method of Statement 16, further indicating the one or more probes are not in fluid communication with the formation when the difference of pressure is null.

Statement 18. The method of Statement 16 or Statement 17, further identifying the type of fluid within tool fluid passageway based on pressure drop during drawdown.

The preceding description provides various embodiments of the systems and methods of use disclosed herein which may contain different method steps and alternative combinations of components. It should be understood that, although individual embodiments may be discussed herein, the present disclosure covers all combinations of the disclosed embodiments, including, without limitation, the different component combinations, method step combinations, and properties of the system. It should be understood that the compositions and methods are described in terms of "including," "containing," or "including" various components or steps, the compositions and methods can also "consist essentially of" or "consist of" the various components and steps. Moreover, the indefinite articles "a" or "an," as used in the claims, are defined herein to mean one or more than one of the element that it introduces.

For the sake of brevity, only certain ranges are explicitly disclosed herein. However, ranges from any lower limit may be combined with any upper limit to recite a range not explicitly recited, as well as, ranges from any lower limit may be combined with any other lower limit to recite a range not explicitly recited, in the same way, ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

Therefore, the present embodiments are well adapted to attain the ends and advantages mentioned as well as those that are inherent therein. The particular embodiments disclosed above are illustrative only, and may be modified and practiced in different but equivalent manners apparent to those skilled in the art having the benefit of the teachings herein. Although individual embodiments are discussed, the disclosure covers all combinations of all of the embodiments. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative embodiments disclosed above may be altered or modified and all such variations are considered within the scope and spirit of those embodiments. If there is any conflict in the usages of a word or term in this specification and one or more patent(s) or other documents that may be incorporated herein by reference, the definitions that are consistent with this specification should be adopted.

What is claimed is:

1. A method comprising:

disposing a formation testing and/or fluid sampling tool into a borehole, wherein the formation testing and/or fluid sampling tool comprises:

one or more probes that extend into a formation;

a probe fluid passageway to connect the fluid from the formation through the one or more probes;

a bubble point valve that connects the probe fluid passageway to a tool fluid passageway;

a probe pressure sensor disposed on the probe fluid passageway;

a tool pressure sensor disposed on the formation testing and/or fluid sampling tool fluid passageway;

moving the formation testing and/or fluid sampling tool to a depth within the borehole;

extending the one or more probes into an inner surface of the borehole;

performing a pressure testing operation;

closing the bubble point valve;

taking a first pressure measurement at the probe pressure sensor;

taking a second pressure measurement at the tool pressure sensor;

retracting the one or more probes from the inner surface of the borehole;

taking a second pressure measurement at the probe pressure sensor;

calculating a difference between the first pressure measurement at the probe pressure sensor and the second pressure measurement at the tool pressure sensor;

calculating a noise in the downhole formation pressure testing operations, wherein the noise comprises a sum of the difference between a pressure distribution from the first pressure measurement at the probe pressure sensor and a pressure distribution from the second pressure measurement at the tool pressure sensor acquired when the one or more probes do not contact the inner surface of the borehole and the difference between a pressure distribution from the first pressure measurement at the robe pressure sensor and a pressure distribution from the second pressure measurement at the tool pressure sensor acquired when the one or more probes are contacting the inner surface of the borehole; and characterizing the noise and noise level during downhole pressure testing and/or sampling operations.

2. The method of claim 1, wherein the first pressure measurement comprises noise.

3. The method of claim 2, wherein the noise comprises a common system noise, operational noise, or formation-related noise.

4. The method of claim 3, wherein the common system noise is from a tool vibration, a gauge-related noise, or another tool.

5. The method of claim 3, wherein the operational noise is from a mud pump rate, a pulser, the depth, and a bit position.

6. The method of claim 3, wherein the operational noise is from a mud thickness and mobility of the formation.

7. The method of claim 1, wherein the second pressure measurement is considered a baseline without external noise.

8. The method of claim 1, further comprising comparing the first measurement taken at the probe pressure sensor to the second measurement taken at the tool pressure sensor.

9. A method of quantifying noise in downhole formation pressure testing operations comprising:

disposing a formation testing tool into a borehole, wherein the formation testing tool comprises:

one or more probes that extend into a formation;

a probe fluid passageway to connect a fluid from the formation through the one or more probes;

a bubble point valve that connects the probe fluid passageway to a tool fluid passageway;

a probe pressure sensor disposed on the probe fluid passageway;

a tool pressure sensor disposed on the tool fluid passageway;

moving the formation testing tool to a depth within the borehole;

extending the one or more probes but without contacting an inner surface of the borehole;

taking a first pressure measurement at the probe pressure sensor;

closing the bubble point valve;

taking a second pressure measurement at the tool pressure sensor;

calculating a difference between the first pressure measurement at the probe pressure sensor and the second pressure measurement at the tool pressure sensor;

extending the one or more probes into the inner surface of the borehole;

performing a pressure testing operation;

taking a first pressure measurement at the probe pressure sensor;

closing the bubble point valve after pressure stabilization;

taking a second pressure measurement at the tool pressure sensor;

calculating a difference between the first pressure measurement at the probe pressure sensor and the second pressure measurement at the tool pressure sensor;

calculating a noise in the downhole formation pressure testing operations, wherein the noise comprises a sum of the difference ee distribution from the first pressure measurement at the probe of pressure sensor pressure distribution from the second pressure measurement at the tool pressure sensor acquired when the one or more probes do not contact the inner surface of the borehole and be difference between a pressure distribution from the first pressure measurement at the probe pressure sensor and a pressure distribution from the second pressure measurement at the tool pressure sensor acquired when the one or more probes are contacting the inner surface of the borehole; and characterizing the noise and noise level during downhole pressure testing and/or sampling operations.

10. The method of claim 9, wherein the first pressure measurement comprises noise when the one or more probes do not contact an inner surface of the borehole.

11. The method of claim 9, wherein the first pressure measurement after extending the one or more probes into an inner surface of the borehole but before closing the bubble point valve comprises noise.

12. The method of claim 11, wherein the noise comprises a common system noise and formation-related noise.

13. The method of claim 12, wherein the common system noise is from a tool vibration, a gauge-related noise, or another tool.

14. The method of claim 12, wherein the formation-related noise is from a mud thickness and mobility of the formation.

15. The method of claim 11, wherein the noise comprises a common system noise and operational noise.

16. A method comprising:

performing a pressure measurement while drilling a formation;

disposing a formation testing tool and/or fluid sampling tool into a borehole at the same location where the pressure measurement while drilling was performed, wherein the formation testing tool and/or fluid sampling tool comprises:

one or more probes that extend into a formation;

a probe fluid passageway to connect the fluid from the formation through the one or more probes;

a bubble point valve that connects the probe fluid passageway to a tool fluid passageway;

a probe pressure sensor disposed on the probe fluid passageway;

a tool pressure sensor disposed on the tool fluid passageway;

moving the formation testing tool to a depth within the borehole;

extending the one or more probes into an inner surface of the borehole;

taking a first pressure measurement at the probe pressure sensor;

closing the bubble point valve;

taking a second pressure measurement at the tool pressure sensor;

calculating a difference between the first pressure measurement at the probe pressure sensor and the second pressure measurement at the tool pressure sensor;

calculating a noise in the downhole formation pressure testing operations, wherein the noise comprises a sum of the difference between a pressure distribution from the pressure measurement while drilling and the difference between a pressure distribution from the first pressure measurement at the probe pressure sensor and a pressure distribution from the second pressure measurement at the tool pressure sensor acquired when the one or more probes are contacting the inner surface of the borehole; and characterizing the noise and noise level during downhole pressure testing and/or sampling operations.

17. The method of claim 16, further indicating the one or more probes are not in fluid communication with the formation when the difference is null.

18. The method of claim 17, further identifying a type of fluid within tool fluid passageway based on pressure drop during drawdown.

* * * * *